US008695973B2

(12) United States Patent
deJong et al.

(10) Patent No.: US 8,695,973 B2
(45) Date of Patent: Apr. 15, 2014

(54) SHEET REGISTRATION FOR A PRINTMAKING DEVICE USING TRAIL EDGE SENSORS

(75) Inventors: Joannes N. M. deJong, Hopewell Junction, NY (US); Lloyd A. Williams, Mahopac, NY (US); Saurabh Prabhat, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 832 days.

(21) Appl. No.: 12/719,503

(22) Filed: Mar. 8, 2010

(65) Prior Publication Data

US 2011/0215522 A1 Sep. 8, 2011

(51) Int. Cl.
*B65H 7/02* (2006.01)

(52) U.S. Cl.
USPC ..... 271/228

(58) Field of Classification Search
USPC ..... 271/226, 227, 228, 249, 252
See application file for complete search history.

(56) References Cited

U.S. PATENT DOCUMENTS

| | | | | |
|---|---|---|---|---|
| 4,971,304 | A | 11/1990 | Lofthus | |
| 5,094,442 | A | 3/1992 | Kamprath et al. | |
| 5,169,140 | A | 12/1992 | Wenthe, Jr. | |
| 5,219,159 | A | 6/1993 | Malachowski et al. | |
| 5,278,624 | A | 1/1994 | Kamprath et al. | |
| 5,678,159 | A * | 10/1997 | Williams et al. | 399/395 |
| 5,715,514 | A * | 2/1998 | Williams et al. | 399/395 |
| 5,794,176 | A | 8/1998 | Milillo | |
| 6,137,989 | A | 10/2000 | Quesnel | |
| 6,168,153 | B1 | 1/2001 | Richards et al. | |
| 6,533,268 | B2 | 3/2003 | Williams et al. | |
| 6,575,458 | B2 | 6/2003 | Williams et al. | |
| 6,634,521 | B1 * | 10/2003 | Hwang | 221/228 |
| 7,422,211 | B2 | 9/2008 | Dejong et al. | |
| 8,256,767 | B2 * | 9/2012 | Williams et al. | 271/228 |
| 2003/0146567 | A1 | 8/2003 | Williams et al. | |

* cited by examiner

*Primary Examiner* — Thomas Morrison
(74) *Attorney, Agent, or Firm* — Hoffmann & Baron, LLP

(57) ABSTRACT

According to aspects illustrated herein, a printmaking device, a method, and a system for reducing process direction errors of a sheet in a registration device is provided herein. The printmaking device includes a feed path, a printing module, and a sheet registration system. The sheet registration system is along the feed path and includes at least one trail edge sensor, a registration controller, and at least one pair of registration nips. The feed path moves a first side of the sheet in a process direction. The registration controller registers the first side of the sheet by: measuring and correcting a first skew error of the sheet; measuring and correcting a first arrival time of the trail edge of the sheet to determine a first process direction position of the sheet; and delivering the first side of the adjusted sheet at a first predefined delivery time.

12 Claims, 8 Drawing Sheets

70

SHEET REGISTRATION FOR A PRINTMAKING DEVICE USING TRAIL EDGE SENSORS

TECHNICAL FIELD

This disclosure relates to apparatus, systems, and methods of accurately registering a sheet in a media handling assembly, such as a printing system or a printmaking device. The various embodiments herein specifically relate to the use of trail edge sensors for accurate sheet registration.

BACKGROUND

In media handling assemblies, particularly in printing systems, accurate and reliable registration of the sheet as it is transferred in a process direction is desirable. In particular, accurate registration of the sheet, such as a sheet of paper, as it is delivered at a target time to an image or ink transfer zone will improve the overall printing process. There are at least three degrees of freedom in which the sheet can move, which need to be controlled in order to achieve accurate delivery thereof. Accurate sheet registration refers to the control or correction of those degrees of freedom in order to deliver a sheet as precisely desired. The sheet is generally conveyed within the system in a process direction. However, often the sheet can shift in a cross-process direction that is lateral (side ways) relative to the process direction. Also, the sheet can even acquire an angular orientation, referred herein as "skew," such that its opposed lateral edges are no longer parallel to the process direction. Further, the sheet velocity may need adjusting in order to timely arrive at a delivery or transfer point (a datum) with a desired speed.

A slight skew, lateral misalignment or arrival time or velocity error of the sheet through a critical processing phase can lead to errors, such as image and/or color registration errors relating to such arrival at a printing station. Contemporary systems transport a sheet and deliver it at a target time to a "datum," based on measurements from one or more of the sheet's edges. The datum can be a particular point in a transfer zone, a hand-off point to a downstream nip assembly or any other target location within the media handling assembly. The lead edge, trail edge, and side edge measurements generally determine whether registration errors exist. After such registration errors are identified, the errors may be corrected prior to delivery at the datum. As the sheet is transferred between sections of the media handling assembly, without registration measurements and corrections the amount of registration error can increase or accumulate, causing pushing, pulling, or shearing forces to be generated, which can wrinkle, buckle, or even tear the sheet(s).

FIG. 1 is a schematic example of a contemporary sheet registration system. The sheet registration system consists of two sets of drive nips, an inboard nip 20 and an outboard nip 30. The nips 20, 30 are mounted with bearings on a shaft 25 so that they are free to rotate. An angular velocity is imparted to each driven nip wheel with a motor, generally controlled by a processing device, referred to as the controller (not shown). Also, the nips 20, 30 are often mounted such that they can be moved laterally along a y-axis. In fact, the motors, nips and related assemblies can all be mounted on a carriage that can move along the y-axis in order to collectively correct lateral registration errors of a sheet engaged by the nips 20, 30, as is further disclosed in U.S. Pat. No. 5,094,442 to Kamprath et al., issued Mar. 10, 1992, and U.S. Pat. No. 6,533,268 B2 to Williams et al., issued Mar. 18, 2003 and U.S. Pat. No. 6,575,458 B2 to Williams et al. issued Jun. 10, 2003 disclose alternative mechanisms for adjusting a sheet's lateral position with an appropriate actuator. These contemporary methods more generally disclose that the nip assemblies can be used to move the sheet in three degrees of freedom, i.e. process, lateral and skew, in order to achieve proper sheet registration.

The skew orientation and time of arrival of a sheet leading edge $L_E$ into a sheet registration system is typically measured by two laterally spaced leading edge sensors Si, So located just downstream of and immediately adjacent to the registration nips 20, 30. A sheet velocity actuator commanded by the controller then executes a command profile in order to timely deliver the sheet to the datum with a prescribed sheet velocity. The sheet velocity can be temporarily sped up or slowed down in order to arrive at the datum at the correct time, with a further change to a target velocity just before delivery. Also, the controller can prescribe different velocities Vi, Vo for the nips 20, 30 to generate, in order to deliver the sheet to the registration datum D with a particular skew or lack thereof. By adjusting the difference between the inboard and outboard sheet velocities Vi, Vo, a skew velocity rotates the sheet as desired, which is used to achieve sheet skew registration. In this way, laterally spaced apart differentially driven drive rollers that are part of the nips 20, 30 are used to adjust a sheet delivery time, velocity and orientation. Examples of sheet registration systems with laterally spaced apart differentially driven drive rollers include the U.S. Pat. No. 4,971,304 to Lofthus, issued Nov. 20, 1990; U.S. Pat. No. 5,169,140 to Wenthe, Jr., issued Dec. 8, 1992; U.S. Pat. No. 5,219,159 to Malachowski et al., issued Jun. 15, 1993; U.S. Pat. No. 5,278,624 to Kamprath et al., issued Jan. 11, 1994; U.S. Pat. No. 5,794,176 to Milillo, issued Aug. 11, 1998; U.S. Pat. No. 6,137,989 to Quesnel, issued Oct. 24, 2000; U.S. Pat. No. 6,168,153 B1 to Richards et al., issued Jan. 2, 2001; U.S. Pat. No. 6,533,268 B2 to Williams et al., issued Mar. 18, 2003; and U.S. Pat. No. 6,866,260 to Williams et al., issued Mar. 15, 2005, the contents of which are incorporated herein by reference.

In order to print onto both sides in a duplex printing environment, the sheet gets inverted, thus making the previously trailing edge $T_E$ the new leading edge. Unfortunately, sheet cut errors often cause the leading and trailing edges to be non-parallel. This introduces improper skew error measurements if the leading edge sensors Si, So are used for skew measurements of the second side. Thus, contemporary systems provide side edge sensors E1, E2 in order to measure skew using a common side edge. While such a system only needs one leading edge sensor, with all the edge measurements (leading edge and side edge) being taken when the sheet first enters the nips 20, 30, the system is limited to open loop control. In other words, continuous or repeated monitoring and/or adjustment of sheet registration between the leading edge sensors Si, So and the delivery datum D (referred to as closed loop control) can not be performed. Alternative contemporary systems place the second side edge sensor E2 downstream of the nips 20, 30, but well before the datum D, which enables closed loop control. However, positioning the second side edge sensor E2 downstream of the nips 20, 30 has the disadvantage that skew control can not start until the edge of the sheet reaches the downstream sensor E2. This delays or does not leave very much time or distance to make corrections before the sheet reaches the datum D. While two leading edge sensors Si, So can once again be used to measure initial skew, the above noted errors in a duplex environment limit the effectiveness of such a system. Also, this increases the number of required sensors, which increases production and maintenance costs.

Accordingly, it would be desirable to provide a method, system, and printmaking device for accurately registering a sheet in a media handling assembly, which overcomes the shortcoming of the prior art.

SUMMARY

According to aspects illustrated herein, there is provided a printmaking device for reducing process direction errors of a sheet in a registration device. The printmaking device includes a feed path, a printing module, and a sheet registration system. The feed path is adapted to move the sheet of paper. The sheet includes a first edge, a second edge, and a first side edge and a second side edge therebetween, with the first edge being approximately parallel to the second edge. The printing module is configured to print an image on the sheet. The sheet registration system is along the feed path and includes a first pair of edge sensors, at least one point sensor, a registration controller, and at least one pair of registration nips. The first pair of edge sensors are configured to measure and correct a first skew error of the sheet. The first pair of edge sensors measure the first skew of one of the following edges of the sheet: the first edge, the second edge, the first side edge, and the second side edge. The at least one point sensor is configured to measure a first arrival time of the first edge of the sheet at a first fixed reference to determine a first process direction position of the sheet. The registration controller is configured to correct skew errors and a process direction position. The at least one pair of registration nips are along the feed path and operatively connected to the registration controller. During printing, the feed path moves a first side of the sheet in a process direction and the registration controller registers the first side of the sheet by: (1) measuring a first skew error of the sheet at one of the following edges of the sheet: the first edge, the second edge, the first side edge, and the second side edge using the first pair of edge sensors; (2) correcting the first skew error by adjusting the sheet using the registration controller; (3) measuring a first arrival time of the first edge of the sheet at a first fixed reference to determine a first process direction position of the sheet using the at least one point sensor, wherein the first edge is the trail edge of the sheet; (4) correcting the first process direction position by adjusting the sheet using the registration controller; and (5) delivering the first side of the adjusted sheet to a first registration datum at a first predefined delivery time.

According to other aspects illustrated herein, there is provided a method for reducing process direction errors of a sheet in a registration device. The method includes moving a first side of the sheet along a feed path in a process direction to the registration device. The sheet having a first edge, a second edge, and a first side edge and a second side edge therebetween, with the first edge being approximately parallel to the second edge. After that, the method measures a first skew error of the first side of the sheet and corrects the first skew error. Next, the method measures a first arrival time of the first edge of the sheet at a first fixed reference to determine a first process direction position of the sheet, the first edge being the trail edge of the sheet. The method then corrects the first process direction position by adjusting the sheet. Finally, the first side of the adjusted sheet is delivered to a first registration datum at a first predefined delivery time.

According to other aspects illustrated herein, there is provided a system for reducing process direction errors of a sheet in a registration device. The system includes a feed path, a first pair of edge sensors, at least one point sensor, a registration controller, and at least one pair of registration nips. The feed path is configured to move the sheet in a process direction, the sheet having a first edge, a second edge, and a first side edge and a second side edge therebetween, with the first edge being approximately parallel to the second edge. The first pair of edge sensors being configured to measure and correct a first skew of the sheet, wherein the first pair of edge sensors measure the first skew of one of the following edges of the sheet: the first edge, the second edge, the first side edge, and the second side edge. The at least one point sensor being configured to measure a first arrival time of the first edge of the sheet at a first fixed reference to determine a first process direction position of the sheet. The registration controller being configured to correct skew errors and a process direction position of the sheet. The at least one pair of registration nips are along the feed path and operatively connected to the registration controller. The feed path moves the sheet in a process direction and the registration controller registers a first side of the sheet by: (1) measuring a first skew error of the sheet at one of the following edges of the sheet: the first edge, the second edge, the first side edge, and the second side edge using the first pair of edge sensors; (2) correcting the first skew error by adjusting the sheet using the registration controller; (3) measuring a first arrival time of the first edge of the sheet at a first fixed reference to determine a first process direction position of the sheet using the at least one point sensor, wherein the first edge is the trail edge of the sheet; (4) correcting the first process direction position by adjusting the sheet using the registration controller; and (5) delivering the first side of the adjusted sheet to a first registration datum at a first predefined delivery time.

Additional features and advantages will be readily apparent from the following detailed description, the accompanying drawings, and the claims. It is to be understood, however, that the drawings are designed as an illustration only and not as a definition of the limits of the disclosure.

BRIEF DESCRIPTION OF THE DRAWINGS

Like reference symbols in the various drawings indicate like elements.

DETAILED DESCRIPTION

Figure 1:
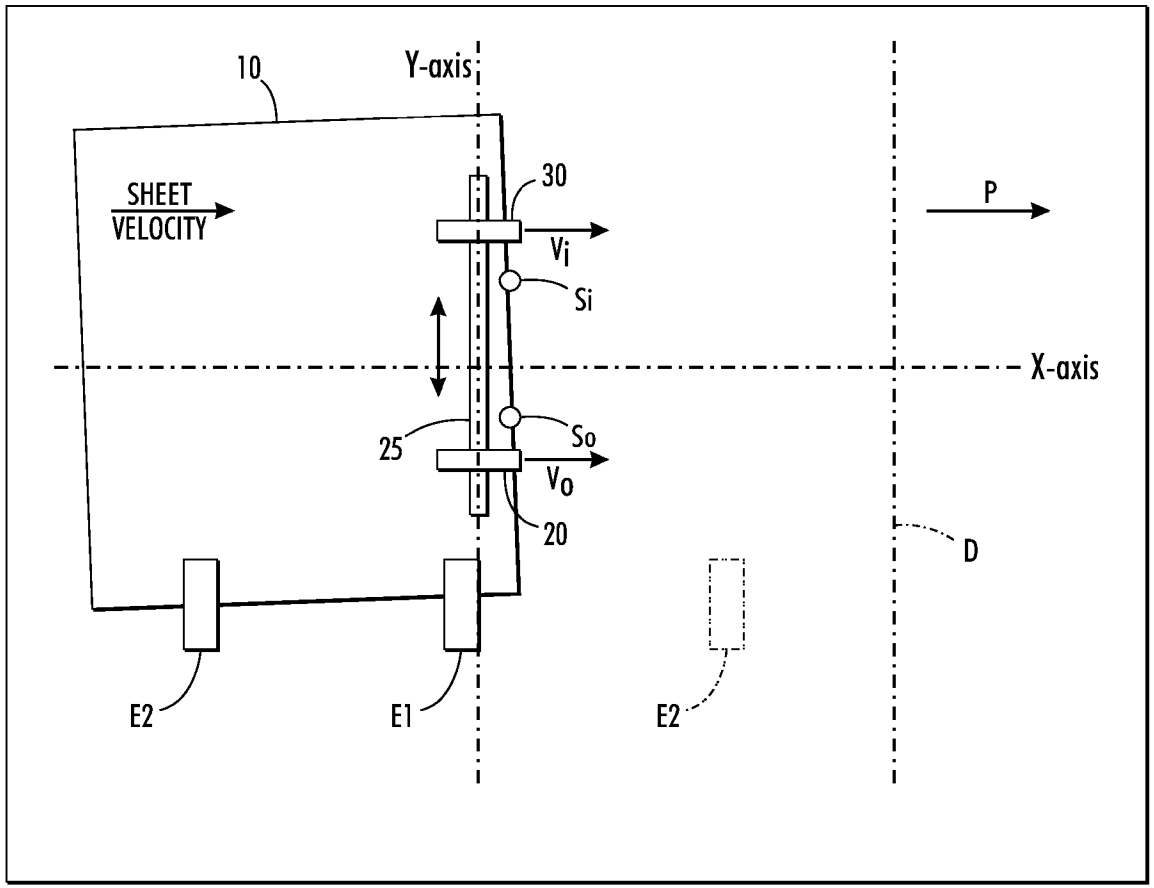
FIG. 1 PRIOR ART
FIG. 1 illustrates a plan view of a prior art sheet registration system.

A method, system, and printmaking device are disclosed herein that provide for registering both sides of a sheet of paper along a feed path of a printmaking device to ensure that the positions of the images on both sides of the paper are aligned. This disclosure provides for correct positioning and timing of a sheet's arrival at the registration datum by correcting skew errors, and optionally, lateral position errors, prior to detecting and correcting process direction errors.

As used herein, the phrase "printmaking device" encompasses any apparatus, such as a digital copier, a bookmaking machine, a facsimile machine, and a multi-function machine, which performs a printing outputting function for any purpose.

As used herein, the term "sheet" encompasses, for example, one or more of a usually flimsy physical sheet of paper, heavy media paper, coated papers, transparencies, parchment, film, fabric, plastic, or other suitable physical print media substrate on which information can be reproduced.

As used herein, the phrase "feed path" encompasses any apparatus for separating and/or conveying one or more sheets into a substrate conveyance path inside a printmaking device.

As used herein, the phrase "process direction" refers to a direction that the feed path moves a sheet.

As used herein, the phrase "process direction position" refers to a position of the sheet with respect to a process position on the feed path.

As used herein, the phrase "lead edge" refers to the edge of a sheet that first advances along the substrate conveyance path.

As used herein, the phrase "trail edge" refers to the edge of a sheet opposite the lead edge. The trail edge is substantially parallel to the lead edge.

As used herein the phrase "printing module" refers to a marking device that uses marking technologies, such as xerographic, inkjet, and offset markings.

As used herein the phrase "registration controller" refers to a device capable of collecting data from sensors, analyzing data, and controlling movement of registration nips.

As used herein, the term "skew" refers to an angular error in the position of the sheet along the feed path.

As used herein, the term "lateral position" refers to a position of the sheet with respect to a lateral location on the feed path.

As used herein, the term "sensor" refers to a sensor that detects the position of a sheet edge. It may use intensity or brightness of light or other physical phenomena. For example, the sensor may be an optical sensor.

As used herein, the phrase "fixed reference" refers to the alignment and configuration of the sensor, which points at a non-changing location to where the sensor collects information. The reference is a fixed reference because the sensor will only detect activity at the configured location. For example, a fixed reference may be a specific location on the feed path and the sensor may be positioned to detect when a sheet is at that specific location.

As used herein, the terms "register" and "registration" refer to determining the proper alignment of a sheet and/or a printing apparatus with respect to a fixed reference.

As used herein, the terms "invert," "inverting," and "inverted" refer to the action of reversing the position of the sheet, such as flipping the sheet from a first side to a second side.

As used herein, the terms "refeed," "refeeding," and "refed" refer to a sheet being conveyed on a feed path for a second time after first moving along the feed path and having an image printed thereon. For example, in a duplex printmaking device, a sheet is fed along the feed path a first time to print an image on a first side, and then the sheet is inverted and then refed along the feed path a second time to print another image on a second side.

As used herein, the phrase "arrival time" refers to a measured time as determined by a sensor or other means.

Figure 2:
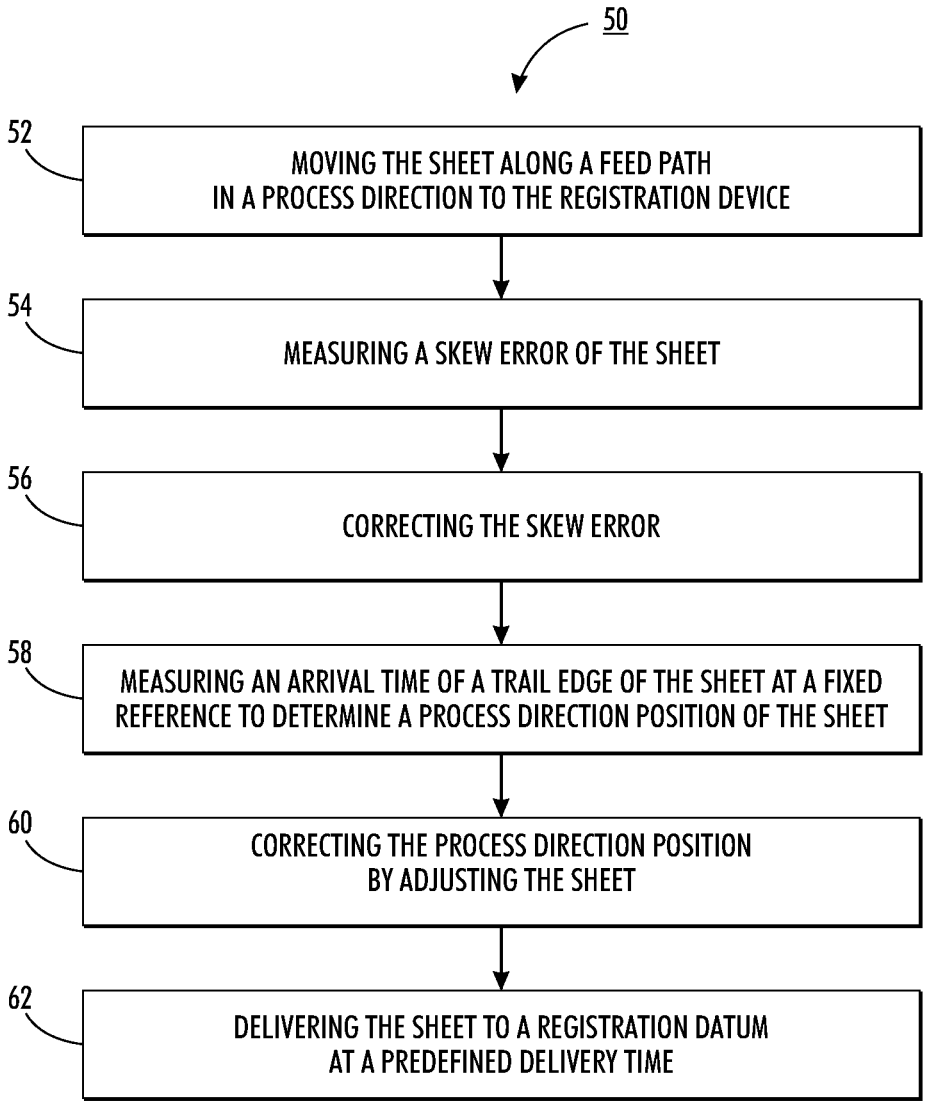
FIG. 2 illustrates a method for reducing process direction errors of a sheet in a registration device.

FIG. 2 provides a method 50 for reducing process direction errors of a sheet in a registration device. In step 52, the sheet moves along a feed path in a process direction to the registration device. The sheet having a first edge, second edge, and two side edges therebetween with the first edge approximately parallel to the second edge. Next, step 54 measures a skew error of the first side of the sheet, and the skew error is then corrected in step 56. After that, step 58 measures an arrival time of the trail edge (first edge) of the sheet at a fixed reference to determine a process direction position of the sheet. The arrival time may be measured by at least one point sensor. Then, the process direction position is corrected by adjusting the sheet in step 60. The sheet may be adjusted using a registration controller. For example, the registration controller may change a speed of one or more registration nips along the feed path. Finally, step 62 delivers the adjusted sheet to a registration datum at a predefined delivery time.

The method 50 of FIG. 2 may further include inverting and refeeding the sheet on a second side and repeating the above steps 52-62 on the second side of the sheet. When the steps are repeated on the second side, the second side of the sheet moves along the feed path in a process direction. The skew error of the second side of the sheet is then measured and corrected. After that, the arrival time of the lead edge (first edge) of the sheet at a second fixed reference is measured by the at least one point sensor. Next, the process direction position is corrected by adjusting the sheet. Then, the second side of the adjusted sheet is delivered to the registration datum at a predefined delivery time.

The method 50 may determine the skew error using at least one pair of edge sensors, with the pair of edge sensors being located on one of the lead edge, trail edge, first side edge, or second side edge. As will be appreciated by those skilled in the art, other known methods may also be used to determine the skew error. After the skew errors are identified, the method may use the registration controller and/or any means known to one skilled in the art to correct the skew error of the sheet.

The method 50 may determine a process direction position of the sheet by measuring the arrival time of the first edge of the sheet using at least one point sensor. After the arrival time is measured, the method may use the registration controller and/or any other means know to one skilled in the art to correct the process direction position of the sheet.

The method 50 of FIG. 2 may additionally be configured to measure a lateral position of the sheet prior to measuring the arrival time of the first edge of the sheet. The lateral position may be measured using one or more lateral sensors, and a lateral error may be corrected using the registration controller. As will be appreciated by one skilled in the art, the lateral position and the lateral error may be identified and corrected using any known means.

As will be appreciated by one skilled in the art, the method 50 may use a system and/or printmaking device in which the same at least one point sensors, pair of edge sensors, one or more lateral sensors, and the same registration devices are used for the registration of both the first side and the second side of the sheet. Alternatively, the method 50 may use a system and/or printmaking device having different at least one point sensors, pair of edge sensors, one or more lateral sensors, and a different registration device for the registration of each of the first side and the second side of the sheet. Moreover, depending on the configuration of the system and/or printmaking device used, the first and second fixed references may be at the same position or different positions along the feed path, and the first and second registration datum may be at the same position or different positions along the feed path.

Figure 3:
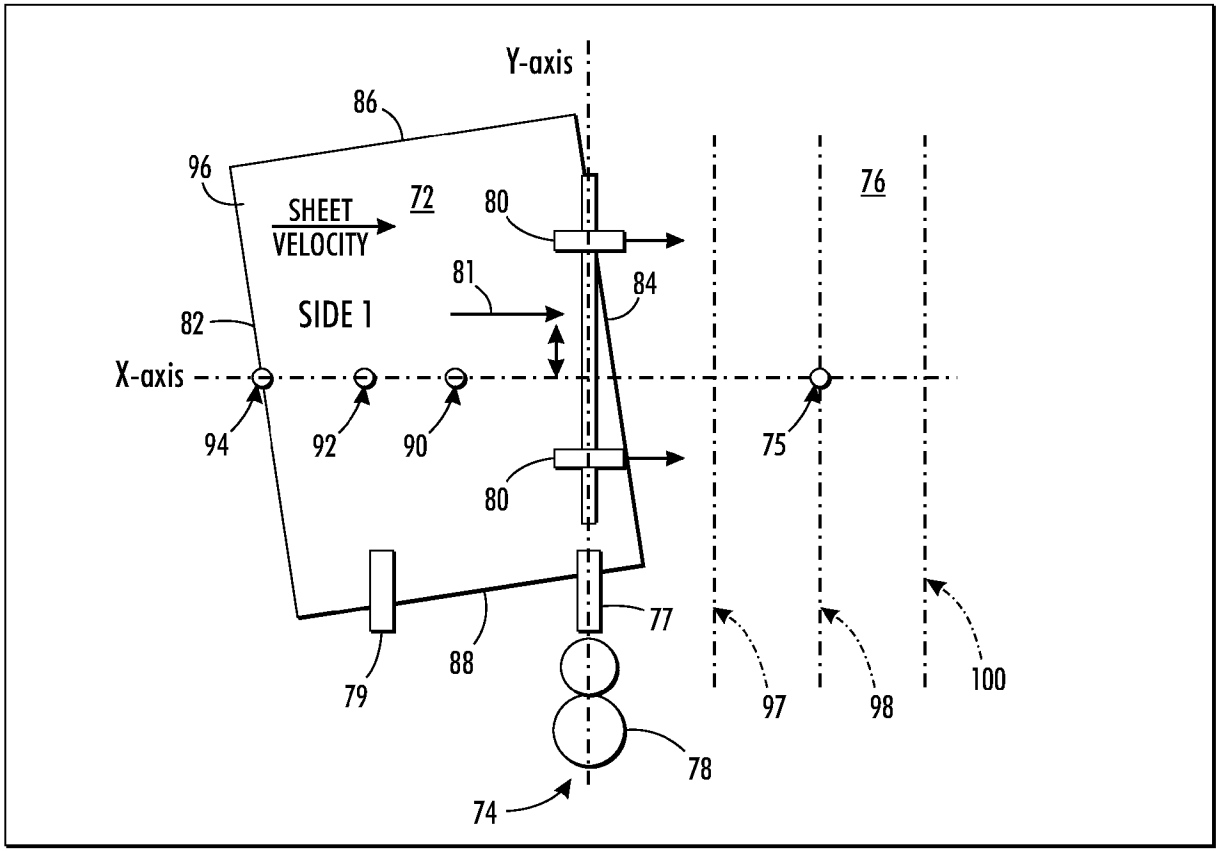
FIG. 3 illustrates a plan view of a system for use with the method of FIG. 2.
Figure 4:
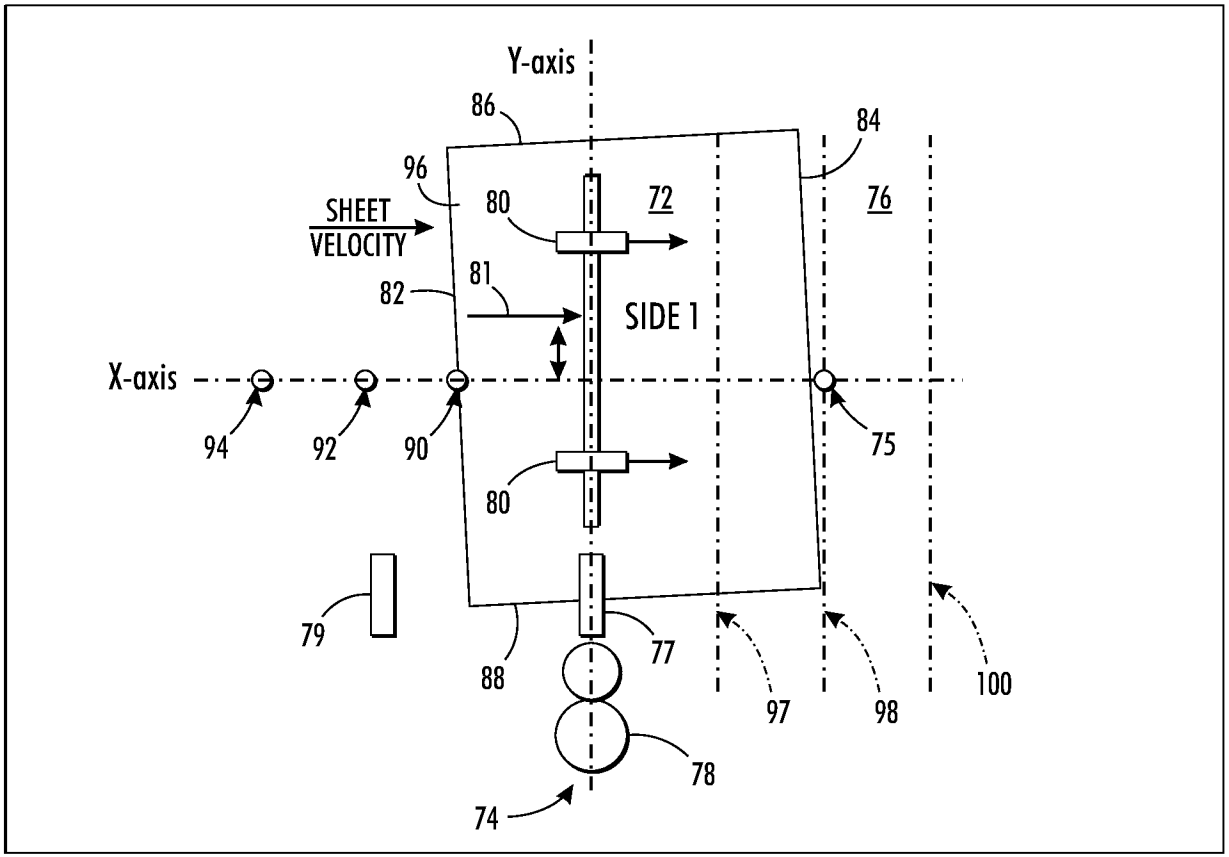
FIG. 4 illustrates a plan view of the system for use with the method of FIG. 2 as the sheet crosses the trail edge sensors.
Figure 5:
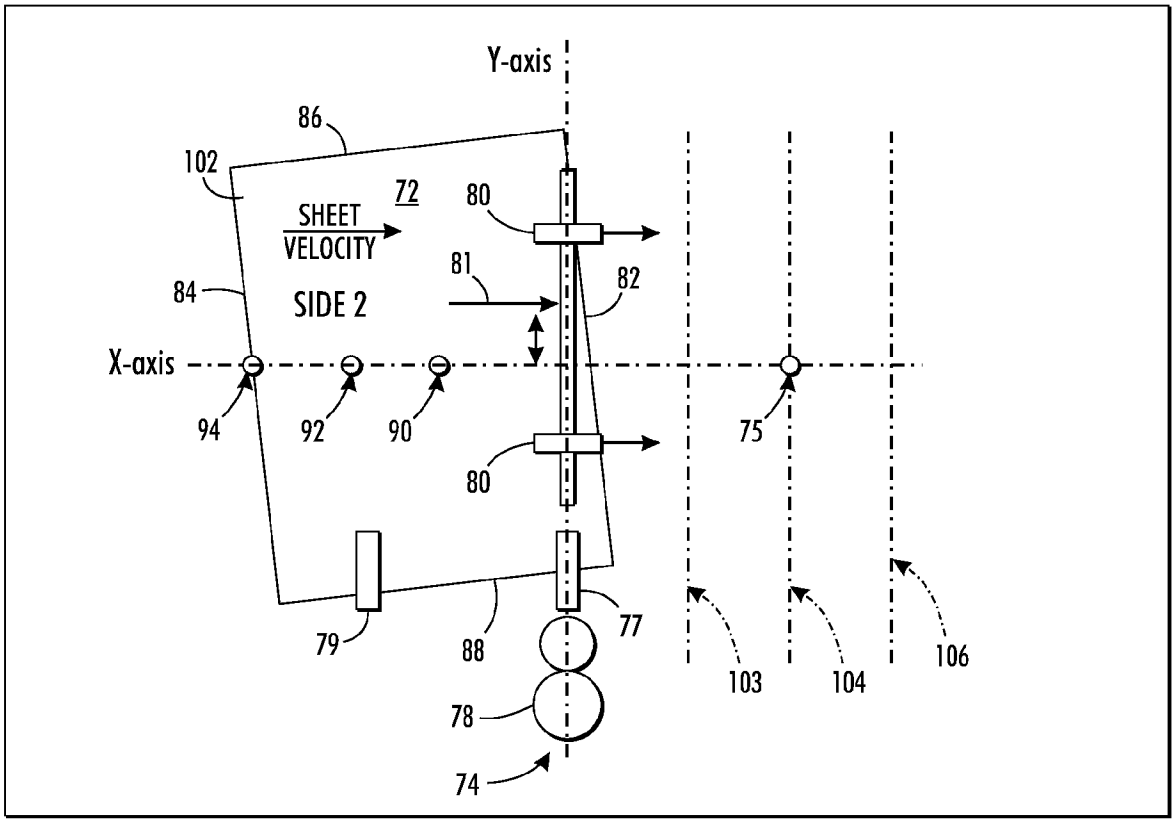
FIG. 5 illustrates a plan view of a system for use with the method of FIG. 2 during duplex printing.

With reference to FIGS. 3-5, a sheet registration system 70 for reducing process direction errors of a sheet 72 in a registration device 74, which may be used with the method 50 of FIG. 2, is provided. FIG. 3 shows the system 70, including a feed path 76, at least one point sensor, at least one pair of edge sensors, a registration controller 78, and at least one pair of registration nips 80. The feed path 76 is configured to move the sheet 72 in the process direction 81. The sheet 72 having a first edge 82, a second edge 84, and two side edges 86, 88 therebetween. The registration controller 78 may be configured to correct skew errors and a process direction position. The at least one pair of registration nips 80 may be located along the feed path 76 and operatively connected to the registration controller 78.

The at least one pair of edge sensors are shown as one pair of edge sensors 77, 79 are configured to measure a skew error of the sheet 72. The pair of edge sensors 77, 79 may measure the skew error of one of the first edge 82, the second edge 84, the first side edge 86, and the second side edge 88 of the sheet 72. The at least one point sensor, shown as a lead edge sensor 75 and three trail edge sensors 90, 92, 94, may be configured to measure a first arrival time of the first edge 82 of the sheet 72 at a first fixed reference 98 to determine a first process direction position of the sheet 72.

Referring to FIG. 4, in operation, a first side 96 of the sheet 72 moves along the feed path 76 in a process direction 81 past the at least one point sensor and a pair of edge sensors 77, 79. After that, the registration controller 78 registers the first side 96 of the sheet 72. The pair of edge sensors 77, 79 measure a first skew error of one of the edges of the sheet 72 prior to the sheet 72 reaching a first fixed reference 98. For example, the first skew error may be measured as the sheet 72 crosses a first skew reference line 97. The first skew reference line 97 may be located along the feed path 76. Moreover, the pair of edge sensors may be located on the feed path 76 along the first edge 82, second edge 84, first side edge 86, or second side edge 88 of the sheet 72. Then, the skew error may be corrected by adjusting the sheet 72 using the registration controller 78, prior to the sheet 72 reaching the first fixed reference 98.

As the sheet 72 moves along the feed path 76 and crosses the first fixed reference 98, fine registration may begin. The at least one point sensor measures a first arrival time of the trail edge of the first side 96 of the sheet 72, using the three trail edge sensors 90, 92, 94, shown as the first edge 82 of the sheet 72, at the first fixed reference 98 to determine a first process direction position of the sheet 72. Next, the registration controller 78 corrects the first process direction position by adjusting the sheet 72 using the registration controller 78. After that, the registration controller 78 delivers the first side 96 of the adjusted sheet 72 to a first registration datum 100 at a first predefined delivery time.

For duplex printing, the system 70 may invert and refeed the sheet 72 on a second side 102, as shown in FIG. 5. The second side 102 of the sheet 72 moves along the feed path 76 in the process direction 81 past the pair of edge sensors 77, 79, and the at least one point sensor, shown as the lead edge sensor 75 and the three trail edge sensors 90, 92, 94. Then, the registration controller 78 registers a second side 102 of the sheet 72.

The registration of the second side 102 of the sheet 72 is completed in the same manner as the registration of the first side 96 of the sheet 72. First, the pair of edge sensors 77, 79 measure a second skew error of one of the edges of the sheet 72 prior to the sheet 72 reaching a second fixed reference 104. For example, the skew error may be corrected as the sheet 72 crosses a second skew reference 103. The second skew reference 103 may be located along the feed path 75. Then, the skew error is corrected by adjusting the sheet 72 using the registration controller 78, prior to the sheet 72 reaching a second fixed reference 104.

As the sheet 72 moves along the feed path 76 and crosses the second fixed reference 104, fine registration may begin. The lead edge sensor 75 measures a second arrival time of the first edge 82 of the sheet 72 at the second fixed reference 104 to determine a second process direction position of the sheet 72. Next, the registration controller 78 corrects the second process direction position by adjusting the sheet 72. Then, the registration controller 78 delivers the second side 102 of the adjusted sheet 72 to a second registration datum 106 at a second predefined delivery time.

The registration controller 78 may further be configured to correct skew errors and/or the process direction position by changing a speed of one or more registration nips 80 of the at least one pair of registration nips 80 along the feed path 76. Using the registration controller 78 to change the speed of the one or more registration nips 80 is one example of how to correct skew errors and/or the process direction position. However, this disclosure contemplates use of the registration controller 78 or using any other means known to one skilled in the art.

The system 70 may further be configured to determine a lateral position error of the sheet 72, prior to measuring the arrival time of the first edge 82 of the sheet 72, which is shown in FIGS. 3-4. For example, the lateral position of the sheet 72 may be determined using one or more lateral sensors. The registration controller 78 may also be configured to correct lateral position errors. However, as will be appreciated by one skilled in the art, the determination of the lateral position error may be determined using any method known to one skilled in the art.

Figure 6:
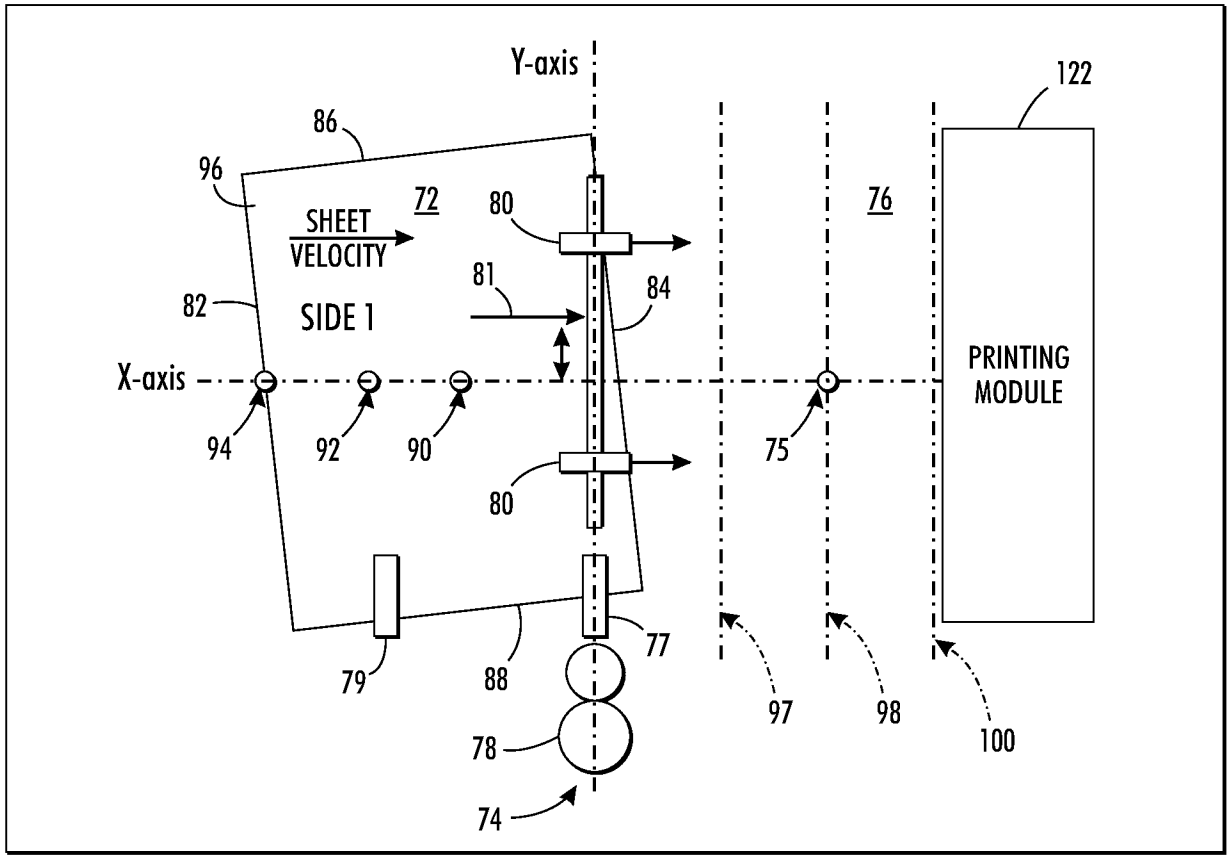
FIG. 6 illustrates a plan view of a printmaking device for use with the method and systems shown in FIGS. 2-5.

Referring to FIG. 6, a printmaking device for use with the method 50 of FIG. 2 and the system 70 of FIGS. 3-5 is provided. The printmaking device 120 includes a feed path 76, a printing module 122, and the sheet registration system 70. The feed path 76 is adapted to move the sheet 72 of paper. The sheet 72 may include a first edge 82, a second edge 84, and two side edges 86, 88 therebetween.

The printing module 122 is configured to print an image on the sheet 72. For example, the printing module 122 may print a first image (not shown) on the first side 96 of the sheet 72 and a second image (not shown) on the second side 102 of the sheet 72. The disclosure contemplates using one or more printing modules 122, where the printing on each side of the sheet 72 may be performed by the same printing module 122 or two separate printing modules 122.

The sheet registration system 70 includes at least one point sensor, a pair of edge sensors 77, 79, a registration controller 78, and at least one pair of registration nips 80. The pair of edge sensors 77, 79 may be configured to measure a first skew error of one of the edges of the sheet 72 prior to the sheet 72 reaching a first fixed reference 98. The pair of edge sensors may be located on the feed path 76 along one of the first edge 82, second edge 84, first side edge 86, or second side edge 88 of the sheet 72. The at least one point sensor may be configured to measure an arrival time of the first edge 84 of the sheet 72, using the trail edge sensors 90, 92, 94, at a first fixed reference 98 to determine a first process direction position of the sheet 72. The registration controller 78 may be configured to correct the skew error by adjusting the sheet 72 using the registration controller 78 and the at least one pair of registration nips 80. The at least one pair of registration nips 80 may be located along the feed path 76 and operatively connected to the registration controller 78.

As previously described and shown in FIG. 4, in operation a first side of the sheet 72 moves along the feed path 76 in a process direction 81 past the at least one point sensor and the pair of edge sensors 77, 79. Then, the registration controller 78 registers the first side 96 of the sheet 72. The pair of edge sensors 77, 79 measure a first skew error of one of the edges of the sheet 72 prior to the sheet 72 reaching a first fixed reference 98. For example, a first skew error may be measured as the sheet 72 crosses a first skew reference line 97. The first skew reference line 97 may be located along the feed path 76. The pair of edge sensors may be located on the feed path 76 along the first edge 82, second edge 84, first side edge 86, or second side edge 88 of the sheet 72. After that, the skew error is corrected by adjusting the sheet 72 using the registration controller 78, prior to the sheet 72 reaching the first skew reference 97.

As the sheet 72 moves along the feed path 76 and crosses a first fixed reference 98, fine registration may begin. The at least one point sensor, shown as the three trail edge sensors 90, 92, 94, measures a first arrival time of the first edge 82 of the sheet 72 at the first fixed reference 98 to determine a first process direction position of the sheet 72. Next, the registration controller 78 corrects the first process direction position by adjusting the sheet 72 using the registration controller 78. After that, the registration controller 78 delivers the first side 96 of the adjusted sheet 72 to a first registration datum 100 at a first predefined delivery time.

The printmaking device 120 may also be configured for duplex printing. During duplex printing, the printmaking device 120 may invert and refeed the sheet 72 on a second side 102, as shown and described above in the sheet registration system 70 of FIG. 5. After the sheet 72 is inverted and refed, the second side 102 of the sheet 72 moves along the feed path 76 in the process direction 81 past the pair of edge sensors 77, 79, and the at least one point sensor, shown as the lead edge sensor 75. Then, the registration controller 78 registers a second side 102 of the sheet 72.

The registration of the second side 102 of the sheet 72 is completed in the same manner as the registration of the first side 96 of the sheet 72. First, the pair of edge sensors 77, 79 measure a second skew error of one of the edges of the sheet 72 prior to the sheet 72 reaching a second fixed reference 104. For example, the skew error may be corrected as the sheet 72 crosses a second skew reference line 103. The second skew reference line 103 may be located along the feed path 76. Then, the skew error is corrected by adjusting the sheet 72 using the registration controller 78, prior to the sheet 72 reaching the second fixed reference 104.

As the sheet 72 moves along the feed path 76 and crosses the second fixed reference 104, fine registration may begin. The lead edge sensor 75 measure a second arrival time of the trail edge of the second side 102 of the sheet 72, shown as the first edge 82 of the sheet 72, at the second fixed reference 104 to determine a second process direction position of the sheet 72. Next, the registration controller 78 corrects the second process direction position by adjusting the sheet 72. Then, the registration controller 78 delivers the second side 102 of the adjusted sheet 72 to a second registration datum 106 at a second predefined delivery time.

The registration controller 78 may further be configured to correct skew errors and/or the process direction position by changing a speed of one or more registration nips 80 of the at least one pair of registration nips 80 along the feed path 76. Using the registration controller 78 to change the speed of the one or more registration nips 80 is one example of how to correct skew errors and/or the process direction position. However, this disclosure contemplates use of the registration controller 78 or using any other means known to one skilled in the art.

The printmaking device 120 may further be configured to determine a lateral position error of the sheet 72, prior to measuring the arrival time of the first edge 82 of the sheet 72, which is shown in FIGS. 3-4. For example, the lateral position of the sheet 72 may be determined using one or more lateral sensors. The registration controller 78 may also be configured to correct lateral position errors. However, as will be appreciated by one skilled in the art, the determination of the lateral position error may be determined using any method known to one skilled in the art.

Figure 7:
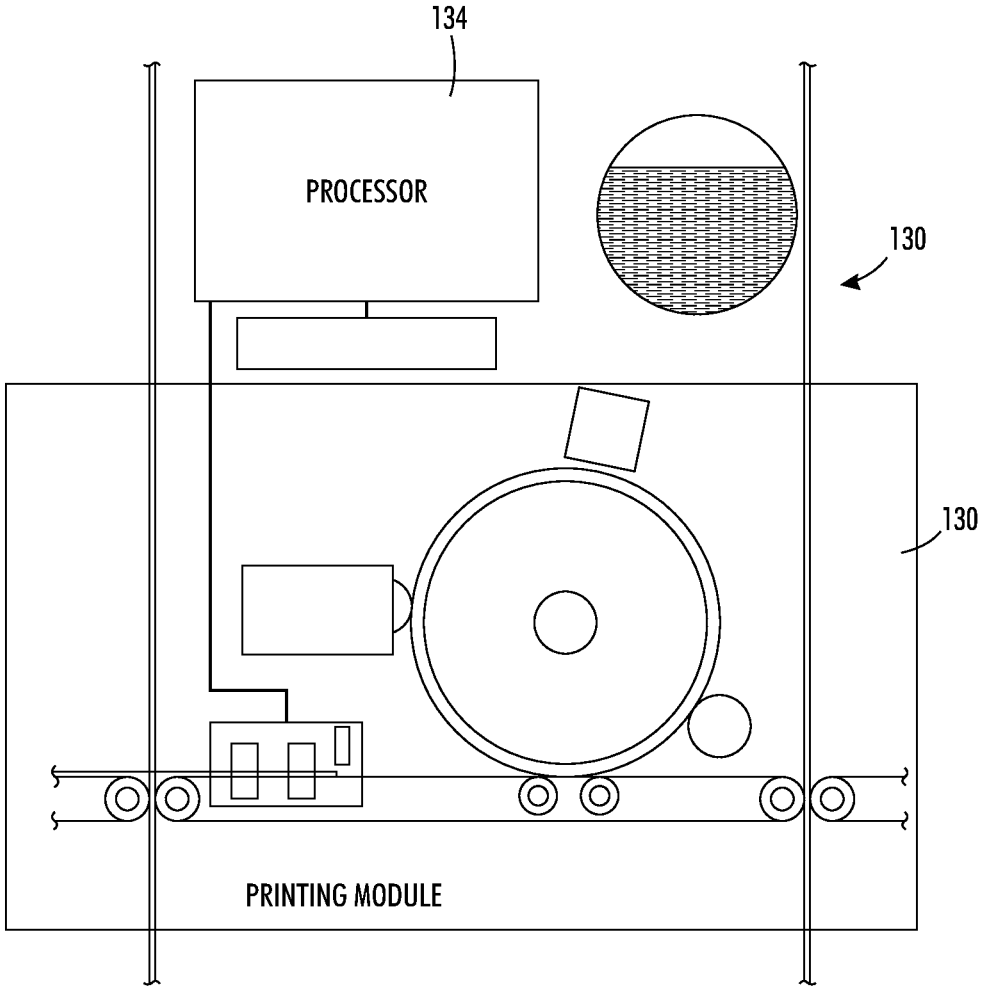
FIG. 7 provides an exemplary printing module for use in the printmaking device of FIG. 6.
Figure 8:
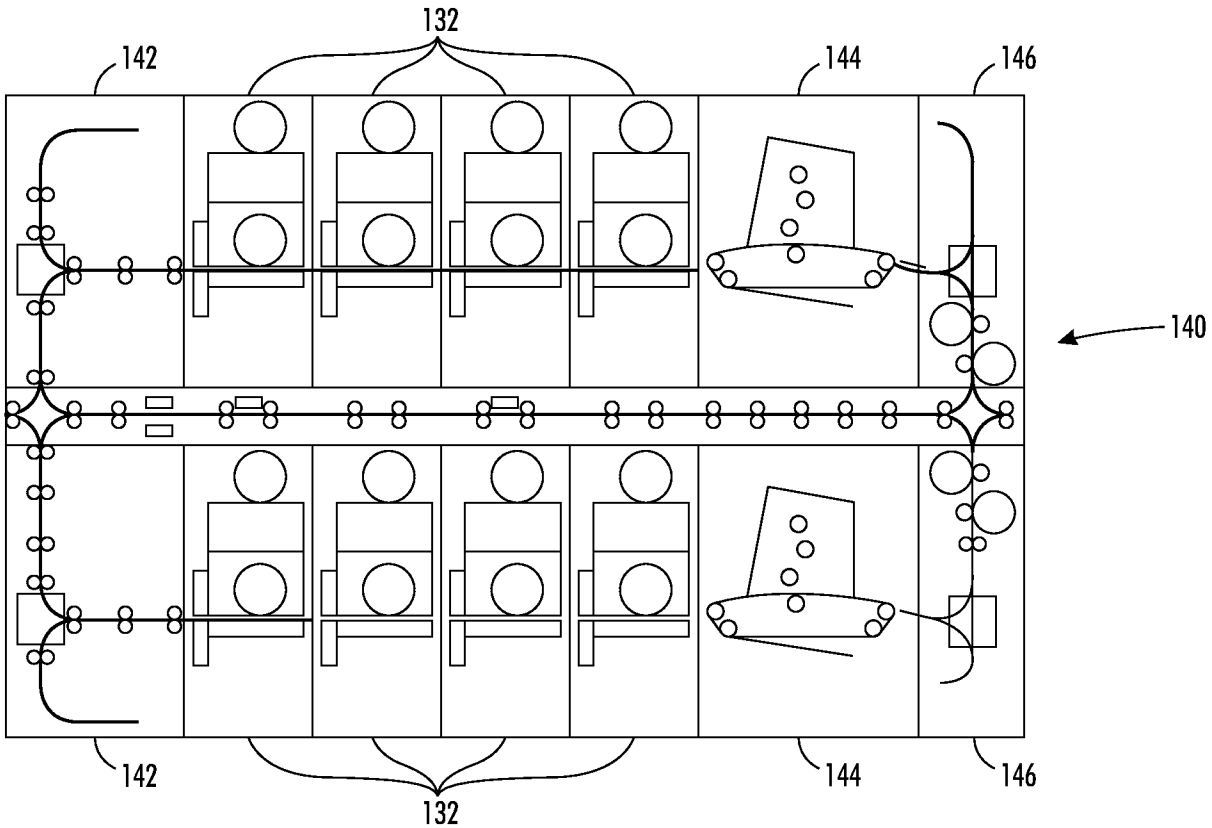
FIG. 8 provides an exemplary arrangement of multiple printing modules.

The printmaking device 120 may further include one or more printing modules 122 for use with modular overprint systems in printmaking devices. FIGS. 7-8 provide examples of printmaking devices 130, 140 with a printing module 132, which may be used with the method 50 and system 70 of FIGS. 2-5. See U.S. patent application Ser. No. 12/364,675, filed on Feb. 3, 2009, contents of which are incorporated herein by reference.

Specifically, FIG. 7 provides an example of a portion of the printmaking device 130 containing the printing module 132. The printing module 132 is connected to a processor 134 in the printmaking device, which may include and/or be operatively connected to a registration controller 78 as described herein. The printing module 132 is capable of printing on the sheet 72 and the processor 134 is capable of controlling the printmaking device 130 and/or printmaking module 132. The printing module 132 and the processor 134 are operatively connected to facilitate proper printing on the sheet 72.

FIG. 8 provides an example of a configuration of multiple printing modules 132 configured for use together with a printmaking device 140. In such configuration, each printing module 132 may include a structure forming a portion of the feed path 76 and printing hardware to place printing material of a predetermined type ("type" referring to color or some other attribute, such as MICR properties) on the sheet 72 passing through the feed path 76: in any other significant aspects, all printing modules 132 are substantially identical in design. In this way, by providing a given number of printing modules 132 along a common sheet path and providing different types of printing material in each printing module 132, the overall printing making device 140 can effectively be custom made.

For example, the design of FIG. 8 contains four printing modules 132, providing a "full color" printer, one with black toner and the others with cyan, magenta, and yellow toners respectively, may be provided. However, as will be appreciated by one skilled in the art additional types of toner for a hexachrome and/or other special-purpose printer may also be added to the configuration. Moreover a "stack" of two sets of printing modules 132, along with input modules 142, fuser modules 144, and sheet exit modules 146, for a high-productivity color printer may be provided.

The method 50, system 70, and printmaking devices 120, 130, 140 described herein are designed to be used in conjunction with a coarse registration method that corrects major registration errors, such that the sheet 72 is provided to the registration device 74 described herein with only minor registration errors. These minor registration errors may include skew, lateral position, and process direction errors. As described above, the errors for skew and lateral position errors may first be corrected using any known means, as may be appreciated by one skilled in the art. Thereafter, the correction of the process direction errors may be corrected using the method 50, system 70, and printmaking devices 120, 130, 140 provided in this disclosure.

The benefits of the method 50, system 70, and printmaking devices 120, 130, 140 provided herein include aligning images based on the skew for the same edge of both the first side 96 and the second side 102 of the sheet 72. Using the system and method provided herein eliminates the first side 96 to second side 102 image on paper registration errors caused by cut sheet tolerances and lead edge/trail edge non-parallelism. An additional benefit is that the system and method provided herein enable the use of low cost sensors to identify the process direction position of the sheet 72.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A printmaking device for reducing process direction errors of a sheet in a registration device comprising:

a feed path adapted to move the sheet, the sheet including a first edge, a second edge, and a first side edge and a second side edge therebetween, wherein said first edge is approximately parallel to said second edge;

a printing module configured to print an image on the sheet; and a sheet registration system along said feed path including a first pair of edge sensors, at least one point sensor, a registration controller, and at least one pair of registration nips;

said first pair of edge sensors being configured to measure and correct a first skew error of the sheet, wherein said first pair of edge sensors measure said first skew of one of the following edges of the sheet: said first edge, said second edge, said first side edge, and said second side edge;

said at least one point sensor being configured to measure a first arrival time of said first edge of the sheet at a first fixed reference to determine a first process direction position of the sheet;

said registration controller being configured to correct skew errors, lateral errors and process direction position; and said at least one pair of registration nips along said feed path and operatively connected to said registration controller;

wherein said feed path moves a first side of the sheet in a process direction and said registration controller is configured to register said first side of the sheet by:

measuring a first skew error of the sheet at one of the following edges of the sheet: said first edge, said second edge, said first side edge, and said second side edge using said first pair of edge sensors;

determining a lateral position error of the sheet;

correcting said first skew error and said lateral position error by adjusting the sheet using said registration controller; then, measuring a first arrival time of said first edge of the sheet at a first fixed reference to determine a first process direction position of the sheet using said at least one point sensor, wherein said first edge is the trail edge of the sheet;

correcting said first process direction position by adjusting the sheet using said registration controller; and delivering said first side of the adjusted sheet to a first registration datum at a first predefined delivery time.

2. The printmaking device of claim 1, wherein said printmaking device inverts and refeeds the sheet on a second side and said feed path moves the sheet along said feed path in said process direction and said registration controller registers said second side of the sheet by:

measuring a second arrival time of said first edge of the sheet at a second fixed reference to determine a second process direction position of the sheet using said at least one point sensor, wherein said second edge is the lead edge of the sheet;

correcting said second process direction position by adjusting the sheet using said registration controller; and delivering said second side of the adjusted sheet to a second registration datum at a second predefined delivery time.

3. The printmaking device of claim 2, wherein said sheet registration system further includes a second pair of edge sensors configured to measure a second skew error of the sheet.

4. The printmaking device of claim 3, wherein said registration controller is configured to correct said second skew error.

5. The printmaking device of claim 4, wherein said registration controller further registers said second side of the sheet by:

measuring said second skew error of the sheet at one of the following edges of the sheet: said first edge, said second edge, said first side edge, and said second side edge using said second pair of edge sensors; and correcting said second skew error by adjusting the sheet using said registration controller.

6. The printmaking device of claim 1, wherein said registration controller corrects said first process direction position of the sheet by changing a speed of one or more registration nips of said at least one pair of registration nips along the feed path.

7. A system for reducing process direction errors of a sheet in a registration device comprising:

a feed path configured to move the sheet in a process direction, the sheet having a first edge, a second edge, and a first side edge and a second side edge therebetween, wherein said first edge is approximately parallel to said second edge;

a first pair of edge sensors being configured to measure and correct a first skew of the sheet, wherein said first pair of edge sensors measure said first skew of one of the following edges of the sheet: said first edge, said second edge, said first side edge, and said second side edge;

at least one point sensor, said at least one point sensor being configured to measure a first arrival time of said first edge of the sheet at a first fixed reference to determine a first process direction position of the sheet;

a registration controller, said registration controller being configured to correct skew errors, lateral position errors, and a process direction position of the sheet; and at least one pair of registration nips along the feed path and operatively connected to said registration controller;

wherein said feed path moves the sheet in a process direction and said registration controller is configured to register a first side of the sheet by:

measuring a first skew error of the sheet at one of the following edges of the sheet: said first edge, said second edge, said first side edge, and said second side edge using said first pair of edge sensors;

determining a lateral position error of the sheet;

correcting said first skew error and said lateral position error by adjusting the sheet using said registration controller; then, measuring a first arrival time of said first edge of the sheet at a first fixed reference to determine a first process direction position of the sheet using said at least one point sensor, wherein said first edge is the trail edge of the sheet;

correcting said first process direction position by adjusting the sheet using said registration controller; and delivering said first side of the adjusted sheet to a first registration datum at a first predefined delivery time.

8. The system of claim 7, wherein said system inverts and refeeds the sheet on a second side and said feed path moves the sheet along said feed path in said process direction and said registration controller registers a second side of the sheet by:

measuring a second arrival time of said first edge of the sheet at a second fixed reference to determine a second process direction position of the sheet using said at least one point sensor;

correcting said second process direction position by adjusting the sheet using said registration controller; and delivering said second side of the adjusted sheet to a second registration datum at a second predefined delivery time.

9. The system of claim 8, wherein said system further includes a second pair of edge sensors configured to measure a second skew error of said second side of the sheet.

10. The system of claim 9, wherein said registration controller is configured to correct said second skew error.

11. The system of claim 10, wherein said registration controller further registers said second side of the sheet by:

measuring said second skew error of the sheet at one of the following edges of the sheet: said first edge, said second edge, said first side edge, and said second side edge using said second pair of edge sensors; and correcting said second skew error by adjusting the sheet using said registration controller.

12. The system of claim 7, wherein said registration controller corrects said first process direction position of the sheet by changing a speed of one or more registration nips of said at least one pair of registration nips along the feed path.

* * * * *